US009567792B1

(12) United States Patent
Maresh

(10) Patent No.: US 9,567,792 B1
(45) Date of Patent: Feb. 14, 2017

(54) CABINET DOOR WITH RETRACTABLE PANEL

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 14/242,815

(22) Filed: Apr. 1, 2014

Related U.S. Application Data

(63) Continuation-in-part of application No. 13/396,588, filed on Feb. 14, 2012, now Pat. No. 8,684,477.

(51) Int. Cl.
*E06B 3/00* (2006.01)

(52) U.S. Cl.
CPC ..... *E06B 3/00* (2013.01)

(58) Field of Classification Search
CPC ..... E06B 3/00; E06B 3/50; E06B 7/28; E06B 7/36; E06B 5/00
USPC ..... 49/348, 349, 352
See application file for complete search history.

(56) References Cited

U.S. PATENT DOCUMENTS 4,575,967 A * 3/1986 Bickerstaff ..... 49/211
4,702,536 A * 10/1987 Kraynak ..... 312/330.1
4,788,794 A * 12/1988 Miller ..... 49/214
5,159,781 A * 11/1992 Glossop et al. ..... 49/375
8,375,646 B2 * 2/2013 Newkirk et al. ..... 52/29
8,555,553 B2 * 10/2013 Block et al. ..... 49/501
8,684,477 B1 * 4/2014 Maresh ..... 312/292
2003/0204996 A1 * 11/2003 Gillett ..... 49/169
2009/0151264 A1 * 6/2009 Boens ..... 49/383
2010/0101149 A1 * 4/2010 Keller ..... 49/399
2011/0203179 A1 * 8/2011 Boens ..... 49/142
2011/0225886 A1 * 9/2011 Block et al. ..... 49/31

* cited by examiner

*Primary Examiner* — Katherine Mitchell
*Assistant Examiner* — Abe Massad
(74) *Attorney, Agent, or Firm* — Nick A Nichols, Jr.

(57) ABSTRACT

A cabinet door assembly is moveably mounted to a cabinet to selectively close a cabinet. The cabinet door has a substantially planar first panel and a substantially planar second panel in a planar parallel configuration. The second panel may retract relative to the first panel upon application of an impact force to the second panel. A stop member may be incorporated to limit the downward movement of the second panel. Ramp surfaces and a guide member cooperate to facilitate upward and/or inward directional movement of the second panel relative to the first panel upon application of an impact force to the second panel.

7 Claims, 12 Drawing Sheets

CABINET DOOR WITH RETRACTABLE PANEL

CROSS-REFERENCE TO RELATED APPLICATION

This application is a continuation-in-part of U.S. patent application Ser. No. 13/396,588 filed Feb. 14, 2012, now U.S. Pat. No. 8,684,477, which claims the benefit of U.S. Provisional Application Ser. No. 61/463,204, filed Feb. 14, 2011, which applications are incorporated herein by reference.

BACKGROUND OF THE INVENTION

The present invention relates to cabinet doors, and in particular to a safety feature integrated within a cabinet door for mitigating injuries due to head and/or body impact with a cabinet door.

Serious injuries due to an impact with a cabinet door are well reported in the media, and are typically caused by a collision with a cabinet door and a person's head. In the most severe injuries, the cabinet door does not yield, or open or close during horizontal impact. In the instance of generally direct horizontal impact with the door edge, the impact force direction is directed toward the axis of rotation of the cabinet door, and thus the cabinet door will not rotate or move in reaction away from the impact force. In the instance of generally vertical impact, such as when a person may be bent over or crouched down, and hit his head against a cabinet door when rising, the impact force is generally parallel to the axis or rotation of the cabinet door, and thus the cabinet door will also not move in reaction away from the impact force. In both of these instances, the door does not yield or move, and the impact force is directly proportional to the impact velocity. This hazardous event may be described with regards to conservation of momentum, where the product of the mass of two colliding objects and their respective velocities is conserved, and wherein $m_1v_1=m_2v_2$, however in the instance of the prior art, the velocity of the cabinet door may be near zero with no cabinet door reactive rotation due to the impact angle, thus causing a significant number of injuries each year. In this respect, a cabinet door with a retractable panel may provide a safety solution to such prior art cabinet door hazards, as in instances when vertically or horizontally directed impact occurs, and wherein a portion of the cabinet door will readily move or collapse away from the impact site, thus greatly reducing the possibility of potential injury

SUMMARY OF THE INVENTION

A cabinet door assembly is moveably mounted to a cabinet to selectively close a chamber. The cabinet door has a substantially planar first panel and a substantially planar second panel in planar parallel configuration. The second panel may retract relative to the first panel upon application of an impact force to the second panel. A stop member may be incorporated to limit the downward movement of the second panel. Oppositely facing ramp surfaces and a guide member cooperate to facilitate upward and/or inward directional movement of the second panel relative to the first panel upon application of an impact force to the second panel.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
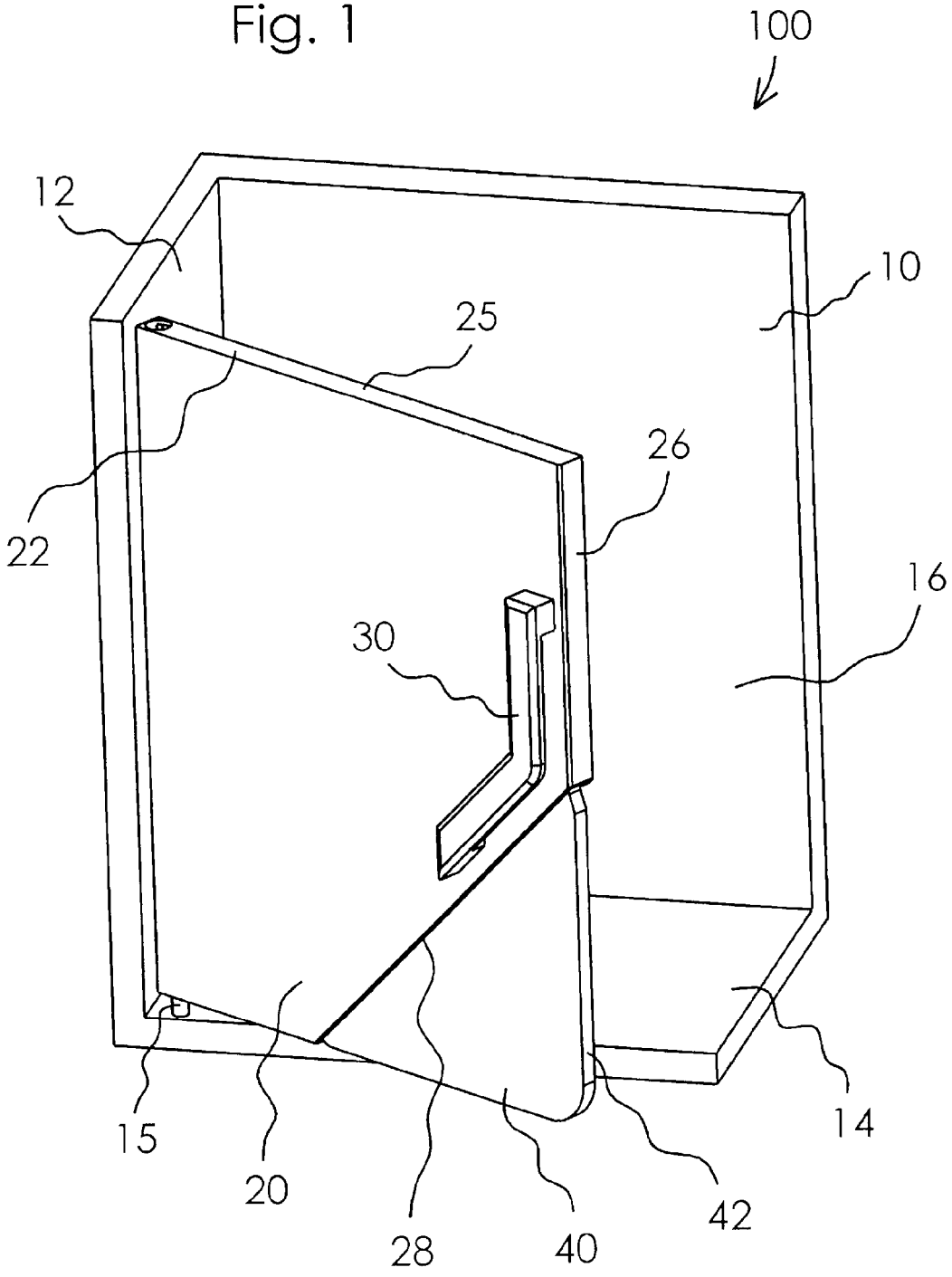
FIG. 1 is a partially broken away front perspective view of a first embodiment of a cabinet door with a retractable panel in a closed position.

Referring first to FIG. 1, a first embodiment of a cabinet, such as a kitchen cabinet, is generally identified by the reference numeral 100. The cabinet 100 is typically rigidly secured to a wall or the like at an elevated position to facilitate convenient access to the interior of the cabinet 100. The cabinet 100 comprises a back wall 10, sidewalls 12, a bottom 14 and a top wall or cover configured and rigidly secured together to define an interior chamber 16. For purposes of convenience in showing the interior structural components of the cabinet 100, the top wall and one of the sidewalls 12 are not shown in the drawings.

A door 20 forms the front of the cabinet 100. The door 20 may be substantially planar and include an upstanding flange 22 extending partially about the perimeter of the door 20. The flange 22 projects outward from and is oriented substantially perpendicular to the back or interior surface of the door 20. The door 20 is rotatably secured at the top and bottom of the cabinet 100 at bearings 15. Other available cabinet door securing means, such as hinges or the like, may be utilized if desired.

The flange 22 includes a rear vertical segment 24, a top horizontal segment 25, a leading vertical segment 26 and a bottom horizontal segment 27. The lower forward or leading end 28 of the door 20 extends at an angle from the lower end of the leading vertical segment 26 to the forward end of the horizontal segment 27 of the flange 22. The flange 22 defines a substantially continuous perimeter about the door 20 with the exception of a gap along the leading end 28 of the door 20.

A door handle 30 may be rigidly secured to the door 20. Levers and/or buttons or the like (not shown in the drawings) may be provided for latching the door 20 or other purposes. Switches for illumination or other electrical functions may also be provided for the cabinet 100.

Figure 2:
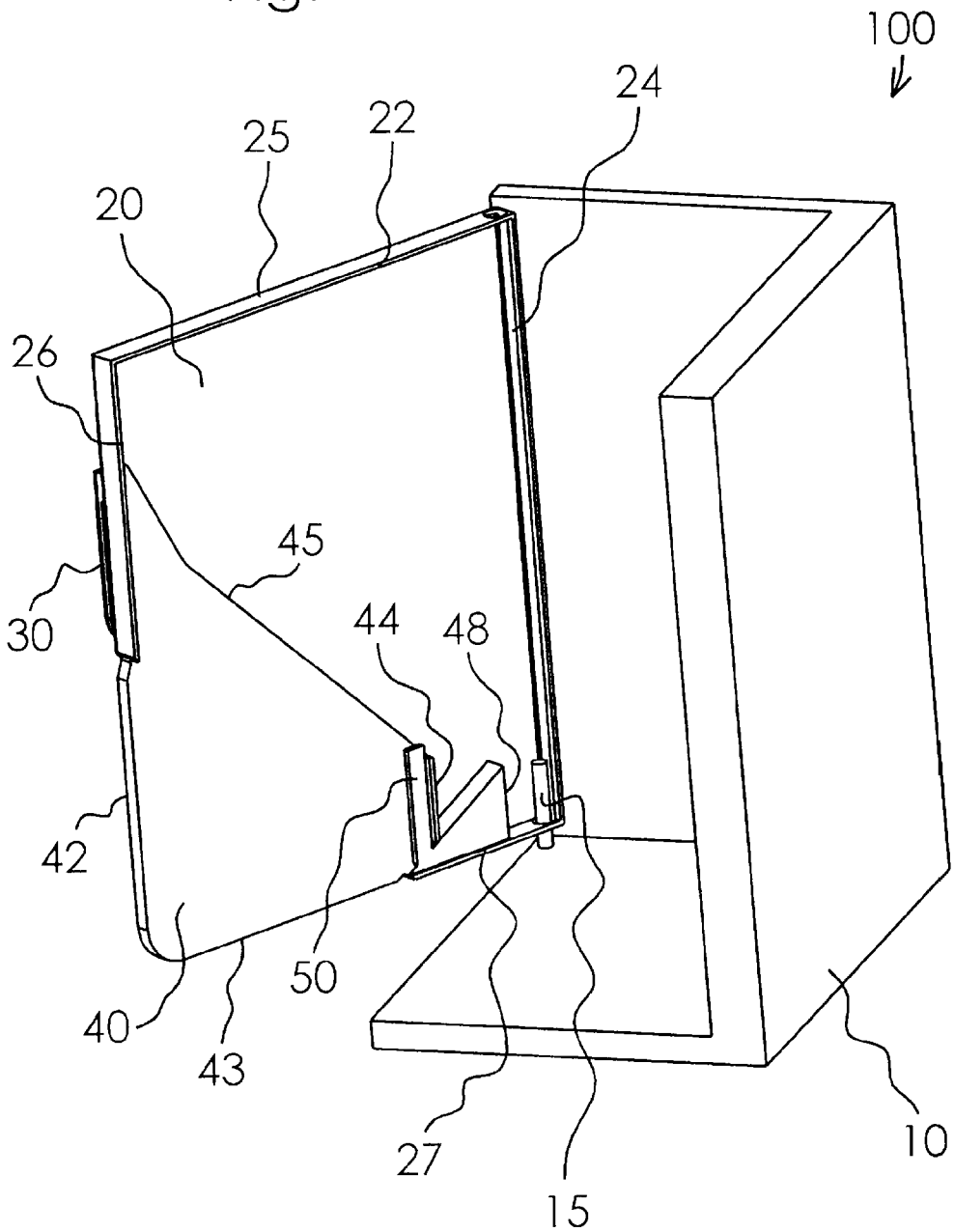
FIG. 2 is a partially broken away side perspective view of the embodiment of the cabinet door shown in FIG. 1.
Figure 3:
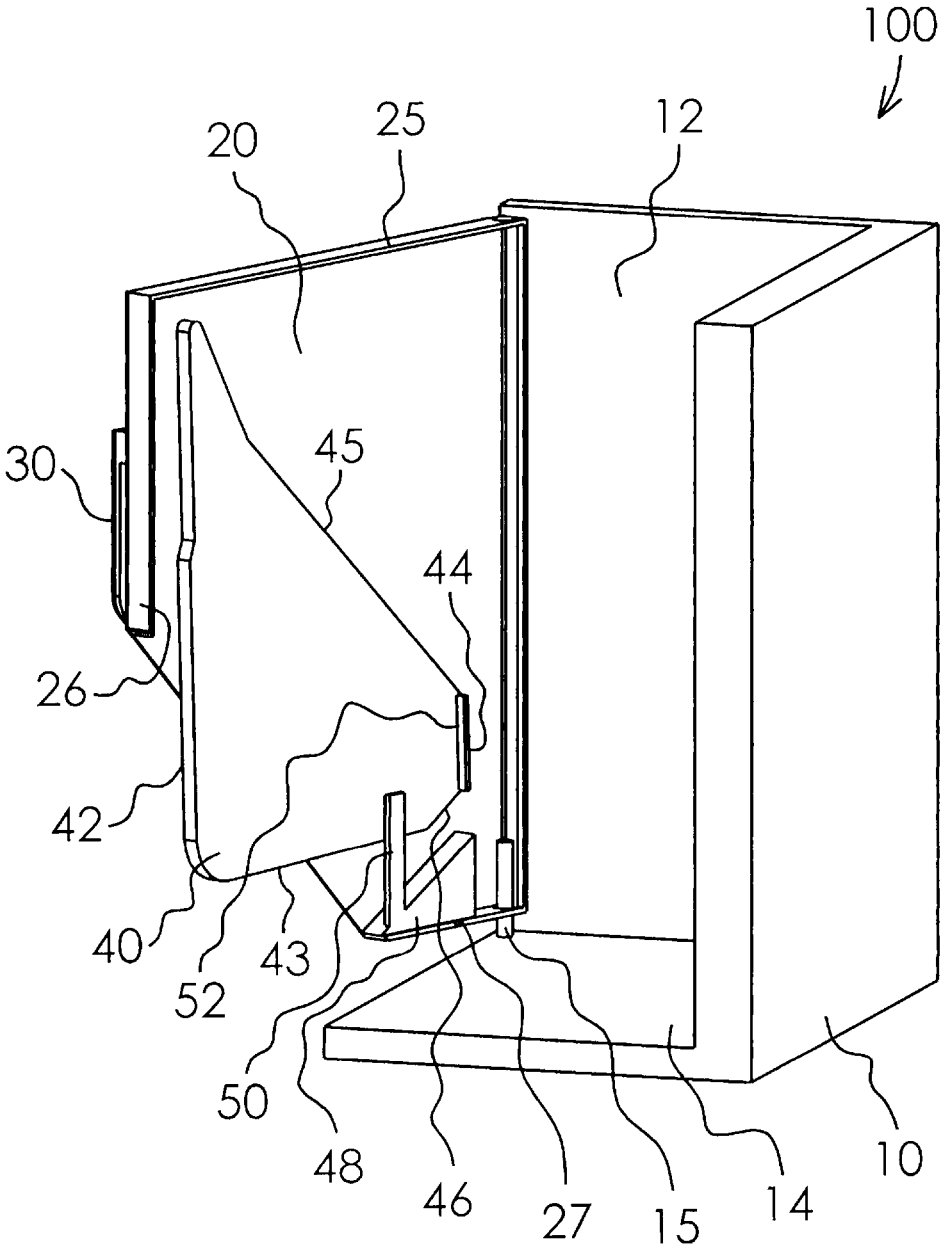
FIG. 3 is a partially broken away side perspective view of the embodiment of the cabinet door shown in FIG. 1 showing the retractable panel in a partially retracted position.
Figure 4:
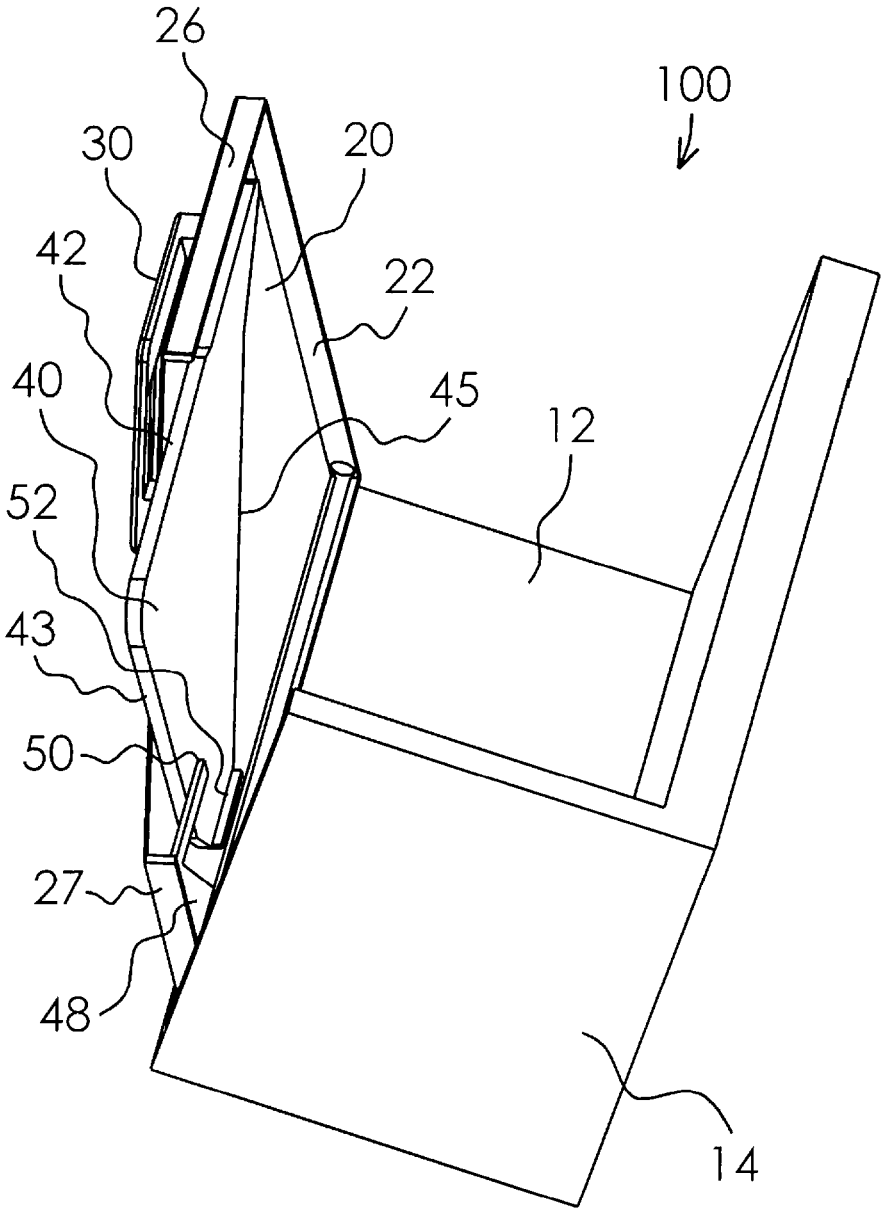
FIG. 4 is a partially broken away bottom perspective view of the embodiment of the cabinet door shown in FIG. 3.

Referring now to FIG. 2, a door panel 40 is generally constrained in a planar parallel manner with the door 20. The door panel 40 is preferably constructed of relatively light materials, for example, sheet metal, wood, glass, plastic or the like. The door panel 40 is moveably mounted on the back surface of the door 20. The door panel 40 may comprise a substantially planar body having a thickness approximately equal to the width of the flange 22 projecting from the back surface of the door 20. The door panel 40 includes a leading vertical edge 42, a horizontal bottom edge 43, a rear vertical edge 44 and an angularly extending edge 45 terminating at the upper end of the leading vertical edge 42 thereof.

The door panel 40 is free to move in an upward and rearward direction relative to the door 20 but constrained to move in a planar parallel manner with respect to the door 20. In the parked or closed position of the door panel 40, as best shown in FIG. 2, the horizontal bottom edge 43 of the door panel 40 is coplanar with the horizontal bottom segment 27 of the flange 22. The rearward end of the horizontal bottom edge 43 of the door panel 40 terminates in an inclined portion defining a ramp surface 46 in facing contact with a ramp 48 secured to the horizontal bottom segment 27 of the flange 22. The inclination angles of the ramp surface 46 and the ramp 48 may be in the range of 30 degrees to 60 degrees, more preferably 45 degrees.

Planar coincidence between the door 20 and the door panel 40 is maintained by a guide 50 fixedly secured and extending vertically upward from the bottom segment 27 of the flange 22. Alternatively, the door 20 may be provided with an interior planar panel secured to the flange 22 thus forming a cavity between front and interior panels of the door 20 for receipt of the door panel 40 therein and thereby maintain planar parallelism between the door 20 and the door panel 40.

A stop member 52 may be provided to limit the downward movement of the door panel 40. The stop 52 may be mounted on the door panel 40 along or proximate the rear vertical edge 44 thereof. Similarly, a stop to limit the upward movement of the door panel may also be provided. Gravity may be sufficient to maintain the door panel 40 in the closed position, however, low friction tape or the like may be employed if desired.

Figure 5:
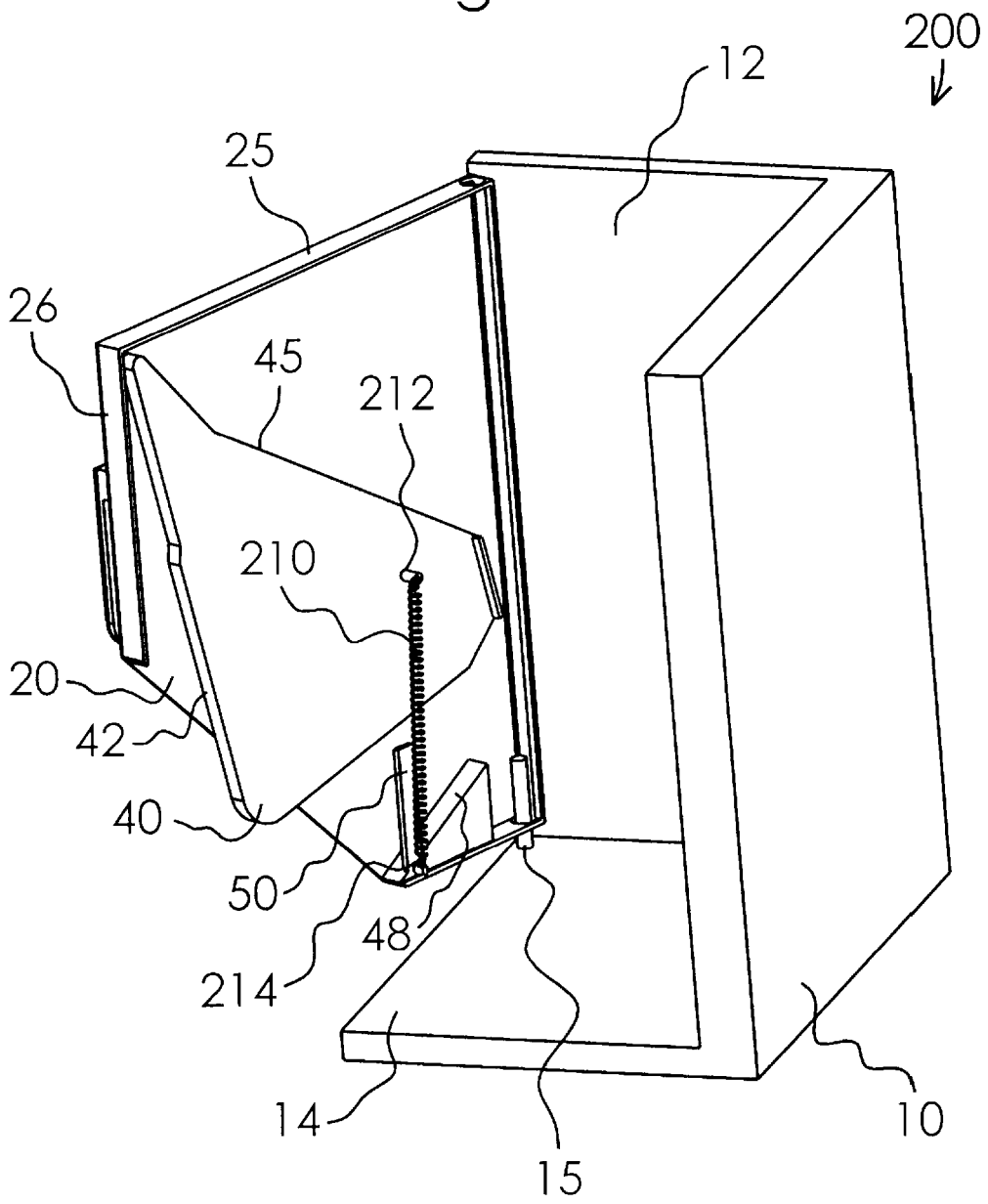
FIG. 5 is a partially broken away side perspective view of a second embodiment of a cabinet door with a retractable panel in a retracted position.

Referring now to FIG. 5, a second embodiment of a cabinet door with a retractable panel is generally identified by the reference numeral 200. The cabinet 200 is substantially similar to the cabinet 100 described above with the exception that the cabinet 200 includes an extension spring 210 having one end 212 secured to the door panel 40 and an opposite end 214 secured to the ramp 48. The spring 210 is maintained in tension for returning the door panel 40 to the closed position after receipt of an impact force.

Figure 6:
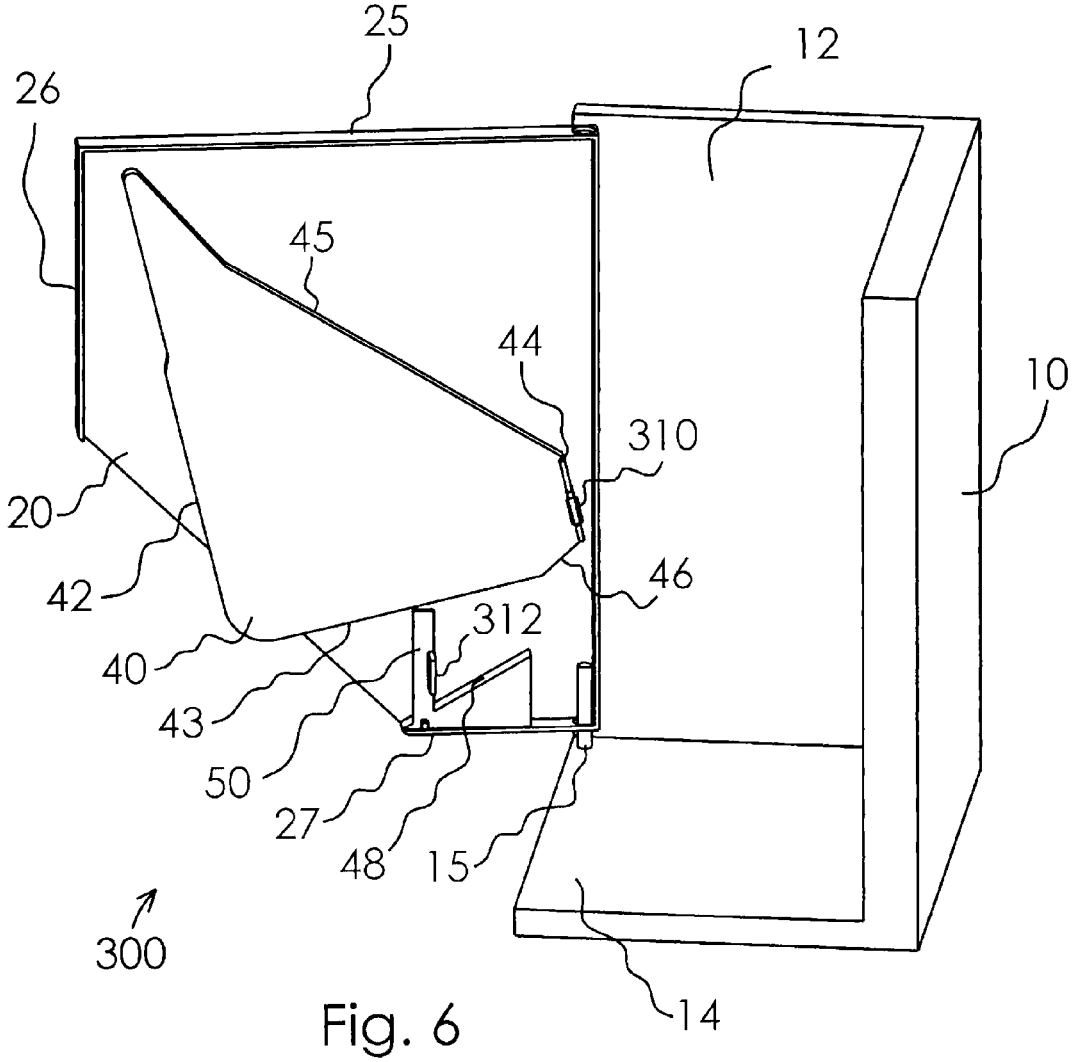
FIG. 6 is a partially broken away side perspective view of a third embodiment of a cabinet door with a retractable panel in a retracted position.

Referring now to FIG. 6, a third embodiment of a cabinet door with a retractable panel is generally identified by the reference numeral 300. The cabinet 300 is substantially similar to the cabinet 100 described above with the exception that the cabinet 300 includes a magnet 310 secured to the stop member 52 and ferrous material 312 secured to the guide 50. The magnet 310 and ferrous material 312 cooperate to maintain the door panel 40 in the closed position.

Referring now to FIGS. 7-12, a fourth embodiment of a cabinet door with a retractable panel is generally identified by the reference numeral 400. The cabinet door 400 comprises a substantially planar door panel 410 and a substantially planar retractable panel 420 movably attached to the door panel 410. A handle 412 for closing or opening the cabinet door 400 may be fixedly secured to the door panel 410. The cabinet door 400 may be rotatably secured to a cabinet mounted at an elevated position on a wall or the like. The cabinet door 400 may be secured to the cabinet by various means known in the art, such as bearing posts, hinges or the like.

The door panel 410 includes a substantially planar front surface 414 and a substantially planar rear surface 416. The thickness of the door panel 410, which may be fabricated from solid wood, particle board or the like, is defined by the front surface 414 and the rear surface 416. A continuous perimeter of the door panel 410 is defined by a rear vertical segment 415, a top horizontal segment 417, a forward vertical segment 418, a bottom horizontal segment 419 and an angular segment 421 extending from the lower end of the forward vertical segment 418 to the forward end of the horizontal segment 419. The angular segment 421 may include a longitudinal ramp surface and/or rounded or fillet edge 422 along the length of the angular segment 421. Alternatively, the angular segment 421 may comprise a combination ramp surface and fillet edge. The vertical segment 418 may include a vertical tab 411 fixedly secured proximate the lower distal end of the vertical segment 418. A horizontal tab 413 may also be fixedly secure to the distal end of the horizontal segment 419. The tabs 411 and 413 overlap the point where the distal ends of the retractable panel 420 engage the angular segment 421 and aid to accurately seat the retractable panel 420 in the deployed position.

Figure 7:
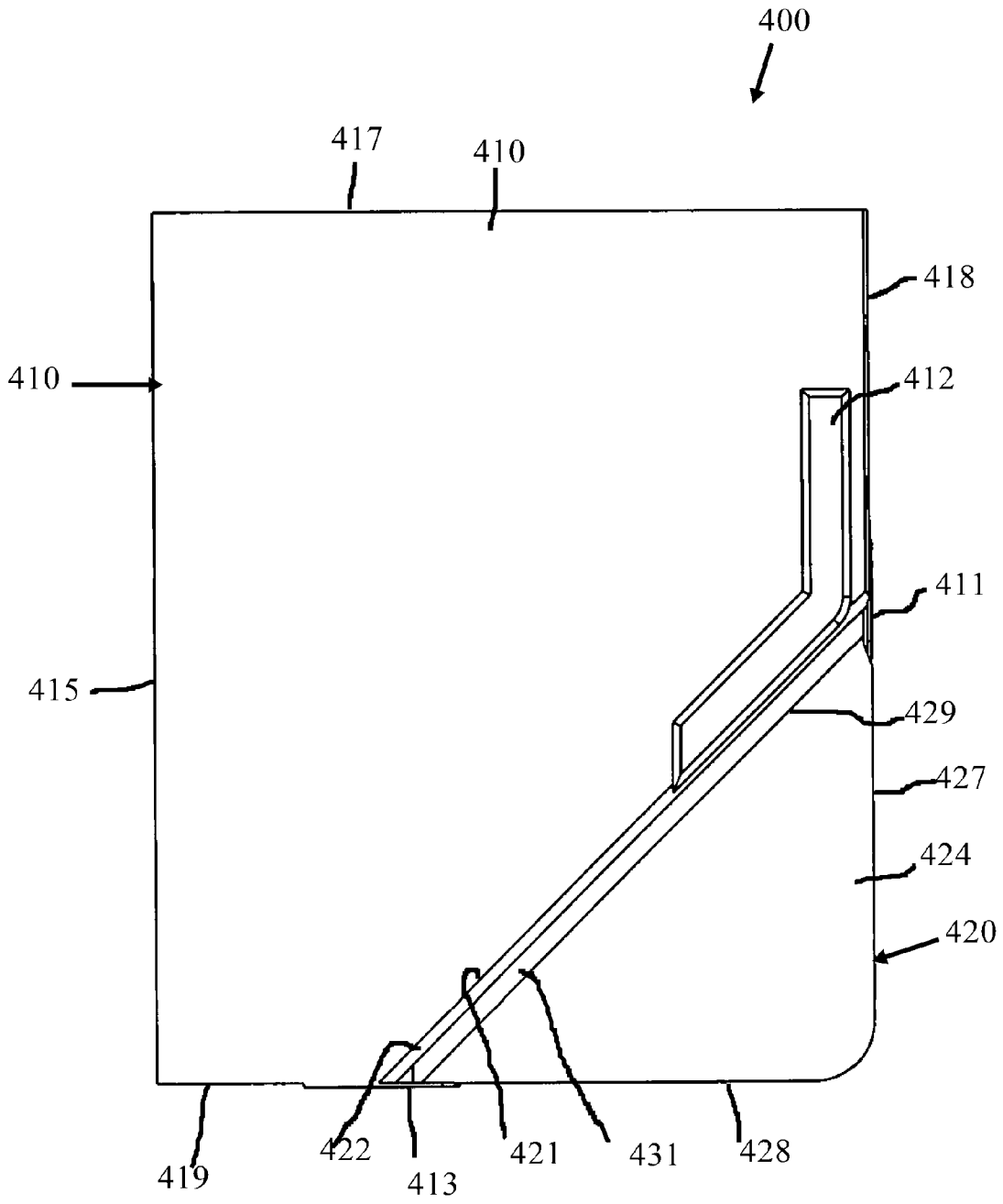
FIG. 7 is a front elevation view of a fourth embodiment of a cabinet door with a retractable panel.
Figure 8:
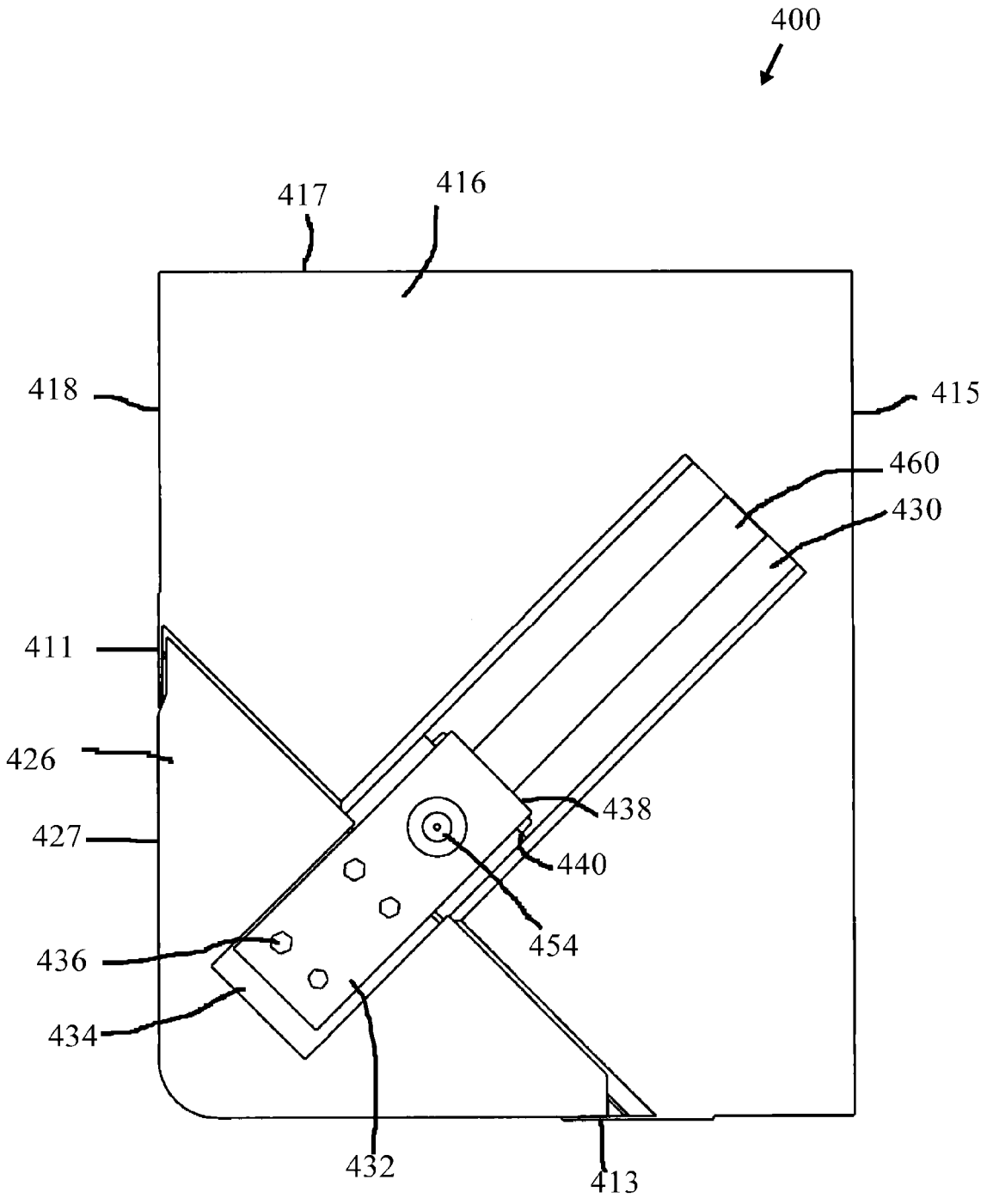
FIG. 8 is a rear elevation view of the embodiment of the cabinet door shown in FIG. 7.
Figure 9:
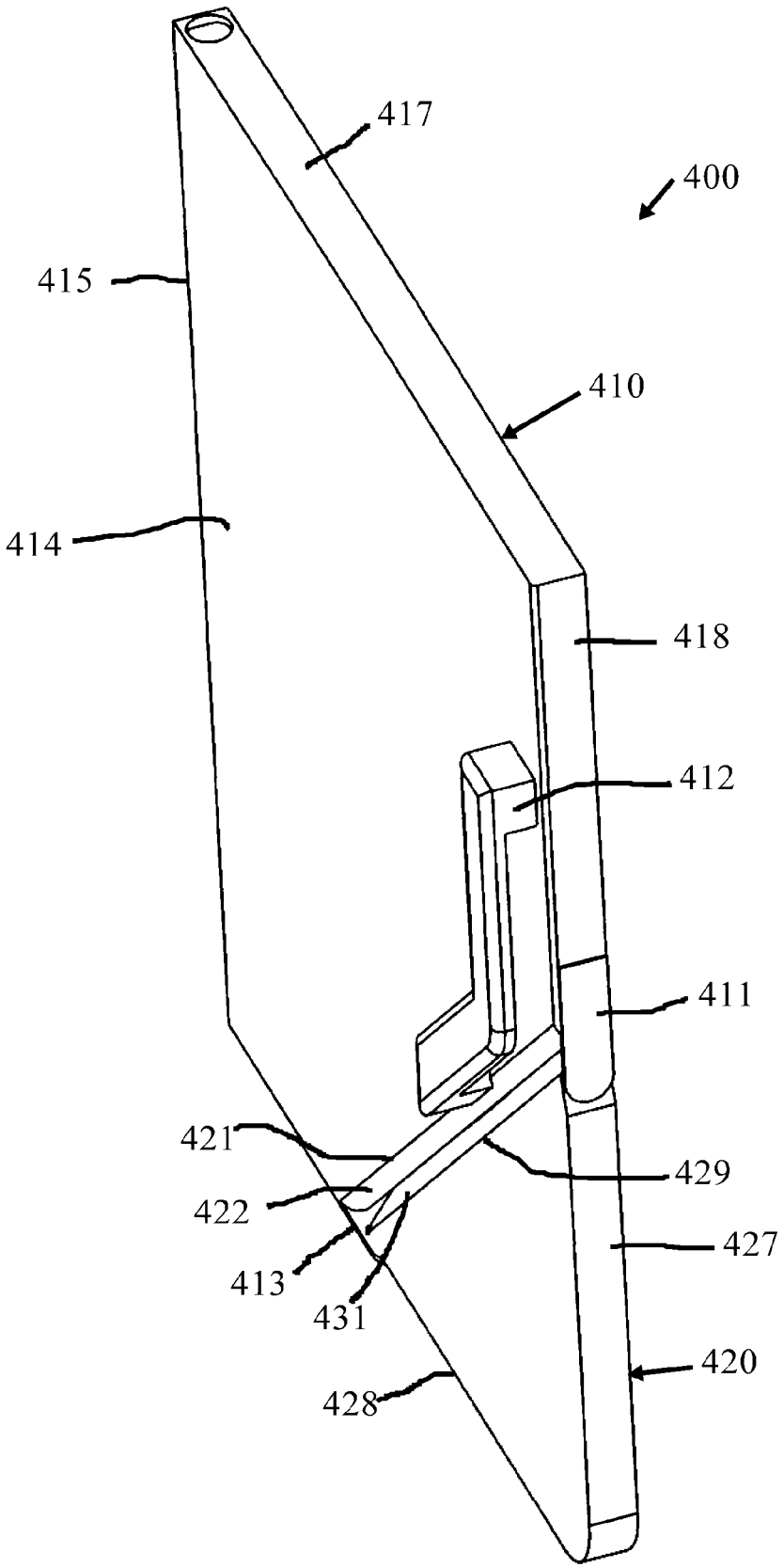
FIG. 9 is a perspective view of the embodiment of the cabinet door shown in FIG. 7.
Figure 10:
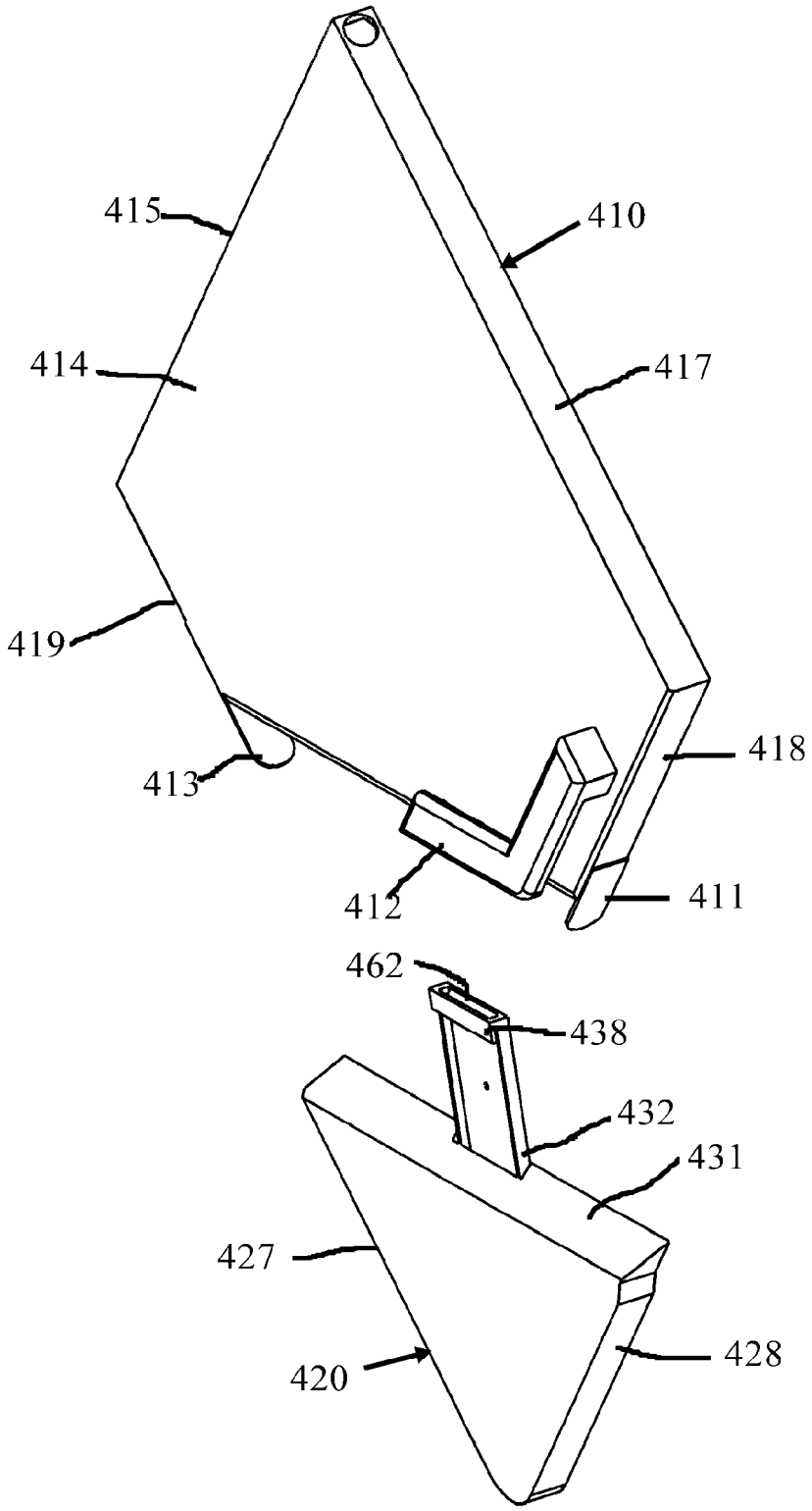
FIG. 10 is an exploded front perspective view of the embodiment of the cabinet door shown in FIG. 7.

The retractable panel 420 includes a substantially planar front surface 424 and a substantially planar rear surface 426. A continuous perimeter of the retractable panel 420 is defined by a substantially vertical segment 427, a substantially horizontal segment 428 and an angular segment 429. The retractable panel 420 forms a generally triangular profile and the thickness of the retractable panel 420 is about the same as the thickness of the door panel 410. In the parked or closed position of the retractable panel 420, as best shown in FIGS. 7 and 8, the door panel 410 and retractable panel 420 are coplanar with each other.

The retractable panel 420 may be moveably secured to the door panel 410. To this end, the door panel 410 may include a recess 430 on the rear side thereof that extends at a generally upward angle. A bracket 432 may be fixedly secured within a recess 434 of the retractable panel 420 with screws, bolts 436 or the like. A forward portion of the bracket 432 extends beyond the angular segment 429 of the retractable panel 420. The forward distal end of the bracket 432 forms an inward turned hook 438. When the retractable panel 420 is in the parked or deployed position, shown in FIG. 8, the hook 438 engages a transverse ledge 440 at the bottom end of the recess 430.

Figure 11:
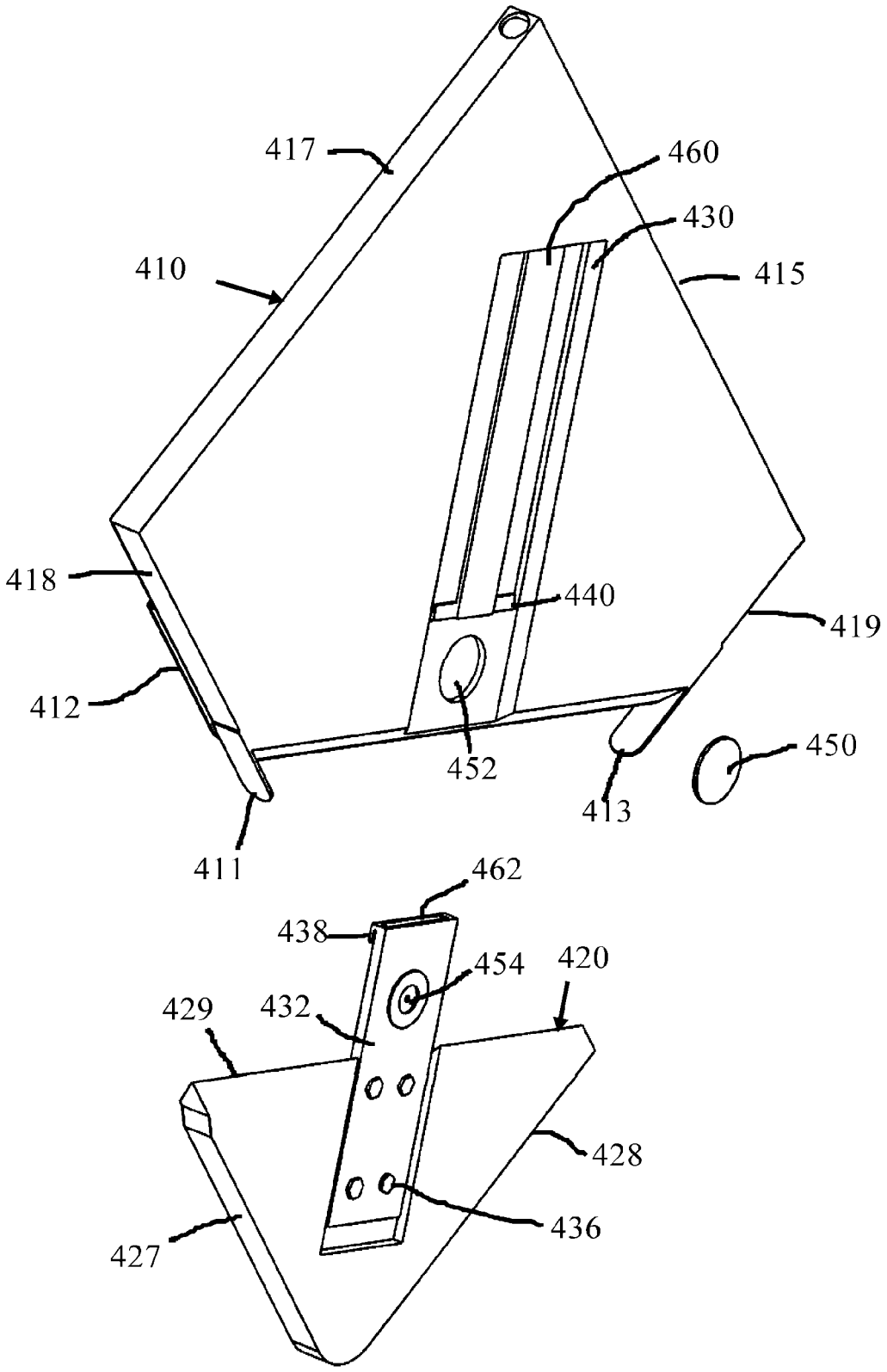
FIG. 11 is an exploded rear perspective view of the embodiment of the cabinet door shown in FIG. 7.

The retractable panel 420 may be maintained in the deployed position by a magnet 450 bonded into a void 452 formed in the rear side 416 of the door panel 410 proximate the angular segment 421 and aligned with the recess 430, as best shown in FIG. 11. The bracket 432 may be fabricated from ferrous material so that magnetic forces hold the retractable panel 420 in the deployed position. Alternatively, the bracket 432 may be fabricated from non-ferrous material, such as plastic or wood, in which case a plug 454 of ferrous material may be fixedly attached to the bracket 432 to magnetically couple the retractable panel 420 to the door panel 410 in the deployed position.

Referring again to FIG. 7, the angular segment 429 of the retractable panel 420 is generally inclined upward from the bottom segment 428 to the upper end of the vertical segment 427. The angular segment 429 of the retractable panel 420 includes a planar longitudinal edge 431 that extends at an angle from the front surface to the back surface of the retractable panel 420. When the retractable panel 420 is in the deployed position, the edge 431 is in cooperative engagement with the edge 422 of the door panel 410. It will be observed that the edges 421 and 431 of the door panel 410 and retractable panel 420, respectively, not limited to linear ramp surfaces but may include contact surfaces having two radii or fillets, as well as ramped surfaces, or a combination thereof.

Figure 12:
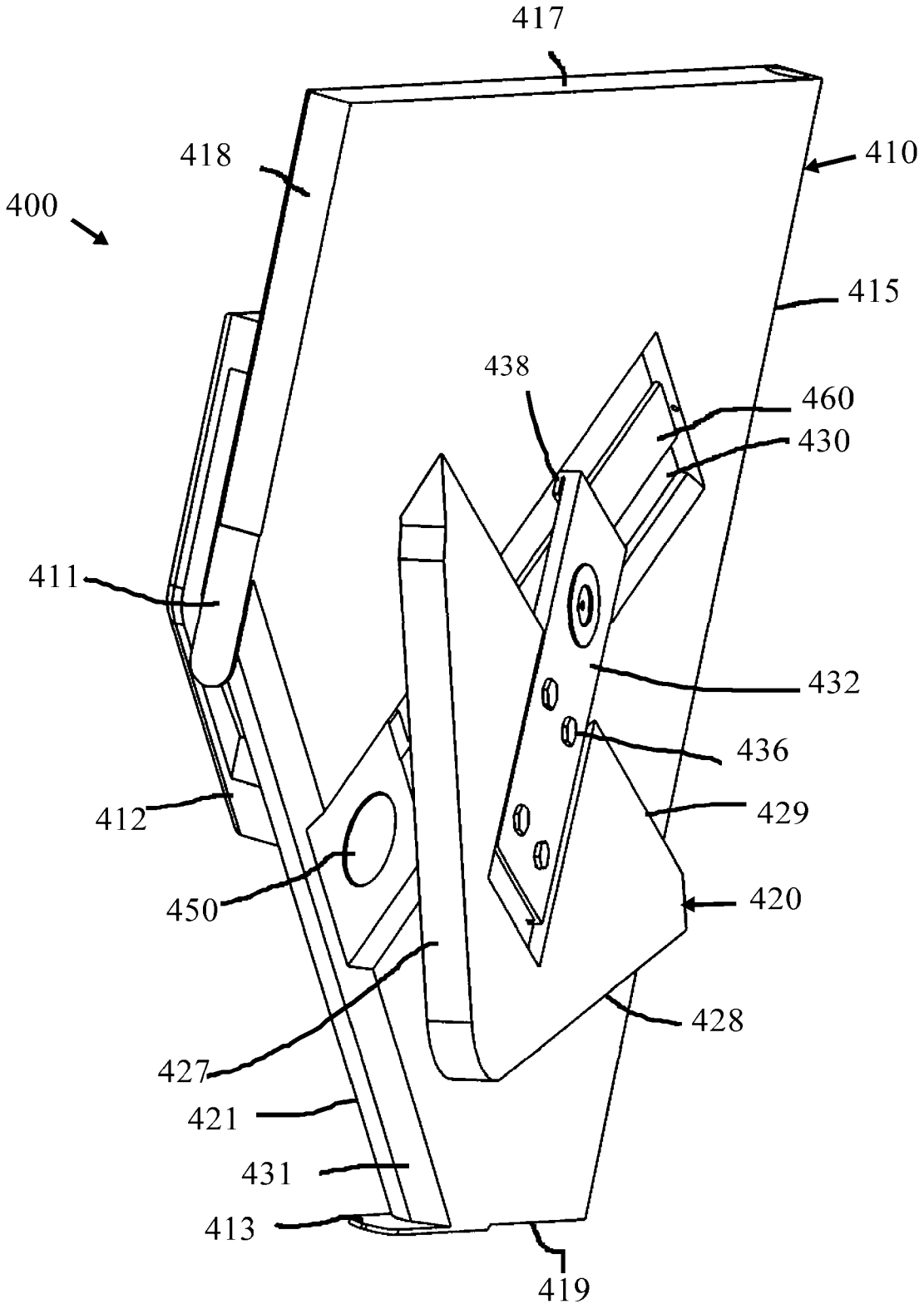
FIG. 12 is a rear perspective of the embodiment of the cabinet door shown in FIG. 7.

Referring now to FIG. 12, during an impact event, the retractable panel 420 disengages from the door panel 410 and slides in a generally backward direction but remains connected to the door panel 410. A slide strip 460 may be fixedly secured in the recess 430. The slide strip 460 extends through a slot 462 in the bracket hook 438. Upon impact, the retractable panel 420 moves along the longitudinal direction of the slide strip 460. The slide stripe 460 may be constructed of plastic material, metal or wood. Alternatively, a flexible metallic or nonmetallic rod, cable, cord, rope and the like may be substituted for the slide strip 460 ensuring that the retractable panel 420 does not fully separate from the door panel 410. As best shown in FIG. 12, the retractable panel 420 translates along the slide strip 460 and reorients in a somewhat variable and haphazard dynamic manner. Parallelism between the retractable panel 420 and the planar rear side 416 of the door panel 410 may not be necessarily maintained.

As will be appreciated by those skilled in the art, the door panel 410 and the retractable panel 420 may be constructed of various materials, including wood, plastic, and/or glass. For example, the door panel 410 may be constructed of wood and the retractable panel 420 may be contracted of glass. A glass retractable panel 420 permits the contents of a cabinet to be viewed. In such an example, the recess 430 and 434 illustrated in FIG. 8 may be omitted.

While preferred embodiments of a cabinet door retractable panel have been shown and described, other and further embodiments thereof may be devised without departing from the basic scope thereof, and the scope thereof is determined by the claims which follow.

The invention claimed is:

1. A cabinet door comprising:

a) a first panel with a substantially planar front surface;

b) a second panel with a substantially planar front surface, the second panel moveably secured to said first panel, wherein said front surface of said second panel is coplanar with said front surface of said first panel when in a deployed position;

c) a magnet fixed to said first panel securing said second panel in the deployed position;

d) a bracket mounted on a rear surface of said second panel, wherein a forward portion of said bracket is slidably received in a recess of said first panel; and e) a slide strip secured in said recess, and wherein said slide strip extends through a slot in said bracket.

2. The cabinet door of claim 1 wherein said first panel includes an angular edge extending from a bottom horizontal edge to a forward vertical edge of said first panel.

3. The cabinet door of claim 1 wherein said second panel includes a horizontal edge, a vertical edge and an inclined edge extending from a distal end of said horizontal edge to a distal end of said vertical edge.

4. The cabinet door of claim 3 wherein said inclined edge of said second panel defines a ramp surface, wherein said first panel includes an angularly extending edge defining a fillet surface, and wherein said ramp surface is in cooperative engagement with said fillet surface when said second panel is in the deployed position.

5. The cabinet door of claim 1 wherein said bracket includes a distal end forming a hook selectively engaging an edge of said recess to limit downward movement of said second panel relative to said first panel.

6. The cabinet door of claim 1 including a magnet secured to said bracket.

7. The cabinet door of claim 1 wherein said bracket comprises a ferrous material.

* * * * *